US010247051B2

(12) United States Patent
Meusel

(10) Patent No.: US 10,247,051 B2
(45) Date of Patent: Apr. 2, 2019

(54) CAMSHAFT MODULE

(71) Applicants: THYSSENKRUPP PRESTA TECCENTER AG, Eschen (LI); thyssenkrupp AG, Essen (DE)

(72) Inventor: Jürgen Meusel, Dittmannsdorf (DE)

(73) Assignees: THYSSENKRUPP PRESTA TECCENTER AG, Eschen (LI); THYSSENKRUPP AG, Essen (DE)

( * ) Notice: Subject to any disclaimer, the term of this patent is extended or adjusted under 35 U.S.C. 154(b) by 3 days.

(21) Appl. No.: 15/568,100

(22) PCT Filed: Apr. 18, 2016

(86) PCT No.: PCT/EP2016/058490

§ 371 (c)(1),
(2) Date: Oct. 20, 2017

(87) PCT Pub. No.: WO2016/169872

PCT Pub. Date: Oct. 27, 2016

(65) Prior Publication Data

US 2018/0142582 A1 May 24, 2018

(30) Foreign Application Priority Data

Apr. 24, 2015 (DE) ..... 10 2015 106 308

(51) Int. Cl.
*F01L 1/053* (2006.01)
*F01L 13/00* (2006.01)
(Continued)

(52) U.S. Cl.
CPC ..... *F01L 1/053* (2013.01); *F01L 13/0036* (2013.01); *F01L 1/46* (2013.01);
(Continued)

(58) Field of Classification Search
CPC ..... F01L 2001/0473; F01L 1/053; F01L 1/46; F01L 2013/0052; F01L 2101/00; F02F 7/006; F02F 2007/0063
(Continued)

(56) References Cited

U.S. PATENT DOCUMENTS

2009/0050102 A1 2/2009 Strandburg
2010/0175652 A1* 7/2010 Schoeneberg ..... F01L 1/047 123/90.21
(Continued)

FOREIGN PATENT DOCUMENTS

DE 102004049031 A 4/2006
DE 102005003079 A 8/2006
(Continued)

OTHER PUBLICATIONS

English Translation of International Search Report issued in PCT/EP2015/068655, dated Oct. 13, 2015 (dated Oct. 20, 2015).
(Continued)

*Primary Examiner* — Jorge Leon, Jr.
(74) *Attorney, Agent, or Firm* — thyssenkrupp North America, Inc.

(57) ABSTRACT

A camshaft module may include a module body in which at least one camshaft for controlling valves for a charge cycle of an internal combustion engine is accommodated. The camshaft may comprise a support shaft and sliding cam pieces that are accommodated on the support shaft so as to be displaceable in an axial direction of the support shaft. A support element may also be provided on which actuators for the axial displacement of the sliding cam pieces are accommodated. The support element may extend in the axial direction and therefore parallel to the support shaft. In some cases, a coefficient of thermal expansion of the support element substantially corresponds to a coefficient of thermal expansion of the support shaft.

19 Claims, 4 Drawing Sheets

(51) Int. Cl.
*F01L 1/46* (2006.01)
*F01L 1/047* (2006.01)
*F02F 7/00* (2006.01)

(52) U.S. Cl.
CPC ..... *F01L 2001/0473* (2013.01); *F01L 2001/0476* (2013.01); *F01L 2013/0052* (2013.01); *F01L 2013/0078* (2013.01); *F01L 2101/00* (2013.01); *F02F 7/006* (2013.01); *F02F 2007/0063* (2013.01)

(58) Field of Classification Search
USPC ..... 123/90.18, 90.19, 90.27, 90.38
See application file for complete search history.

(56) References Cited

U.S. PATENT DOCUMENTS

| | | | | |
|---|---|---|---|---|
| 2012/0031361 | A1 | 2/2012 | Ickinger | |
| 2013/0276564 | A1* | 10/2013 | Popp | F16H 21/44 74/110 |
| 2015/0135531 | A1 | 5/2015 | Binder | |
| 2017/0167324 | A1* | 6/2017 | Ammann | F01L 13/0036 |

FOREIGN PATENT DOCUMENTS

| | | | |
|---|---|---|---|
| DE | 102006059188 | A | 6/2008 |
| DE | 102007003966 | A | 7/2008 |
| DE | 102010036899 | A | 2/2012 |
| DE | 102011050484 | A | 11/2012 |
| DE | 102011111580 | A | 2/2013 |
| DE | 102011088994 | A | 6/2013 |
| DE | 102012105230 | A | 12/2013 |
| DE | 102012209860 | A | 12/2013 |
| DE | 102012016672 | A | 2/2014 |
| WO | 2004083611 | A | 9/2004 |

OTHER PUBLICATIONS

English abstract for DE102005003079.
English abstract for DE102011088994.

* cited by examiner

CAMSHAFT MODULE

CROSS REFERENCE TO RELATED APPLICATIONS

This application is a U.S. National Stage Entry of International Patent Application Serial Number PCT/EP2016/058490, filed Apr. 18, 2016, which claims priority to German Patent Application No. DE 10 2015 106 308.5 filed Apr. 24, 2015, the entire contents of both of which are incorporated herein by reference.

FIELD

The present disclosure generally relates to camshaft modules, including camshaft modules in internal combustion engines with increased operational reliability in wide temperature areas.

BACKGROUND

A camshaft module is known, for example, from DE 10 2011 111 580 A1. The camshaft module has a module body, and the module body is substantially constructed from a hood and from a number of bearing bridges for rotatably accommodating two camshafts. A plurality of actuators which, upon appropriate activation, can axially adjust the sliding cam pieces shown on a support shaft are accommodated in the hood. The hood of the module body is generally formed from aluminum or from a special plastics material. By contrast, the camshaft comprises a steel material, and therefore coefficients of thermal expansion which differ from one another arise for the material of the module body and for the camshaft. However, for reasons of lightweight construction, the module body is preferably produced from aluminum or from a special plastic, and, for technical reasons, in particular for strength reasons, the at least one camshaft accommodated in the module body, in particular the support shaft, is produced from a steel material.

During use of a camshaft module in an arrangement on an internal combustion engine, a pronounced difference in temperature of the camshaft module can be achieved depending on the operating state. For example, when the internal combustion engine is started up, a temperature of −40 degrees can prevail, and, at high load ranges of the internal combustion engine, the camshaft module can heat up to, for example, up to 150 degrees.

On account of the differing coefficients of thermal expansion of the camshaft, in particular the support shaft, and the module body, dimensional deviations in the position of the actuators relative to the positions of the sliding cam pieces can arise in the axial direction. The actuators have actuator pins which, upon activation of the actuators, engage in slotted guides which are provided on the outer side in the sliding cam pieces. Depending on arising operating temperatures of the camshaft module, different thermal expansions of the module body and the camshaft may mean that secure engagement of the actuator pin in the slotted guide is ensured. Thermally induced deviations in the position of the actuator pin relative to the position of the slotted guide can be up to 0.5 mm, in particular depending on the overall length of the module body in the axial direction, and therefore, in particular when further tolerances are accumulated, the function of the axial adjustment of sliding cam pieces of the camshaft is no longer ensured, and increased wear of the camshaft module can arise.

DE 10 2011 088 994 A1 deals with a valve drive for the cylinder head of an internal combustion engine, wherein the pickup side is described for picking up the stroke information from the camshaft via pivot lever and roller element. The valve drive comprises a shaft support in which a camshaft and eccentric shaft are mounted. It is stated here that the support element and the cylinder head are formed from an identical material, for example from light metal material, such as aluminum. As a result, materials comprising approximately identical coefficients of thermal expansion are paired with one another in order to avoid thermal stresses between the support element and the cylinder head. The same selection of material for the support element and the cylinder head is technically possible here, but this technical possibility, as described above, is not possible for the camshaft module of the present type.

DETAILED DESCRIPTION

Figure 1:
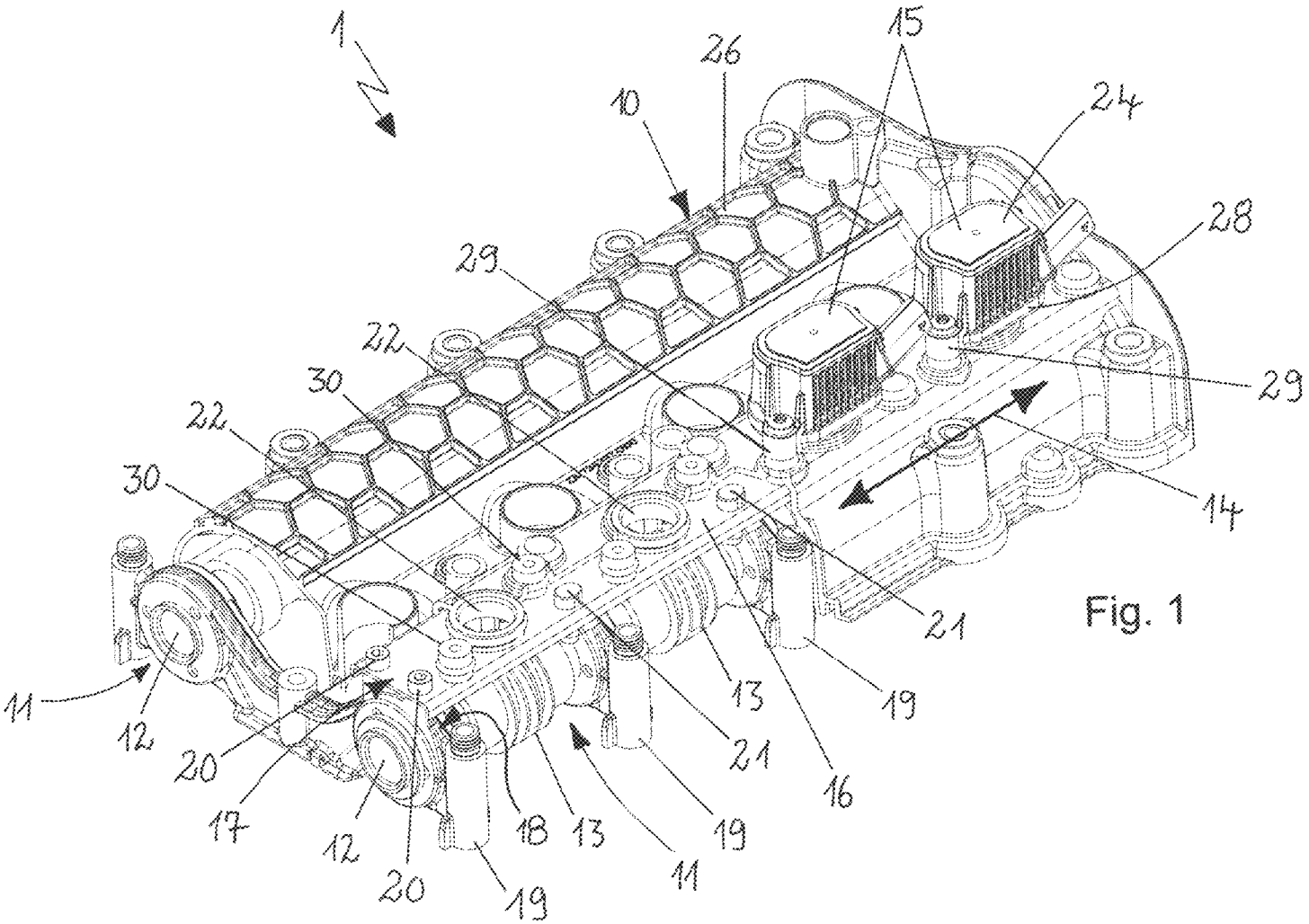
FIG. 1 is a perspective view of an example camshaft module of an example module body with a support element, wherein a hood of the module body is illustrated partially sectioned.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by 'at least one' or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The present disclosure generally relates to a camshaft module with a module body in which at least one camshaft for controlling valves for the charge cycle of an internal combustion engine is accommodated, wherein the camshaft comprises a support shaft and a plurality of sliding cam pieces which are accommodated on the support shaft so as to be displaceable in the axial direction of the support shaft.

In some example camshaft modules having a module body, at least one camshaft is accommodated for controlling valves for the charge cycle of an internal combustion engine, wherein the operational reliability is intended to be increased, in particular within a wide temperature area. In particular, the wear of the camshaft module is intended to be reduced.

The invention includes the technical teaching that a support element is provided, on which actuators for the axial displacement of the sliding cam pieces are accommodated, wherein the support element extends in the axial direction and therefore parallel to the support shaft.

The essence of the invention is a decoupling of actuators which can be accommodated on the camshaft module from the module body of a camshaft module. The decoupling takes place in such a manner that the actuators are no longer shifted in relation to the sliding cam pieces by thermal expansion of the module body since the actuators can be accommodated in a manner held mechanically on the support element, and, if the support element runs, according to the invention, parallel to the support shaft of the camshaft, thermal expansions of the module body can be disregarded since the actuators are decoupled from the module body by means of the support element.

Thermal expansions which arise in the module body are no longer transmitted to the actuators, and therefore the latter also no longer shift in relation to the sliding cam pieces, in particular in the axial direction of the support shaft. As a result, the actuator pin of the actuators is securely engaged in the slotted guides which are provided on the outer side in the sliding cam pieces. In particular in the case of long camshaft modules which can reach, for example, lengths of up to 50 cm or more, even in the event of great temperature differences, actuators which are arranged spaced apart far from one another and interact with sliding cam pieces on a common support shaft can be reliably operated.

According to an advantageous embodiment, the support element comprises a coefficient of thermal expansion which corresponds to the coefficient of thermal expansion of the support shaft or is at least similar thereto. By means of the choice of materials for the support element and for the support shaft of the camshaft having identical coefficients of thermal expansion, the advantage is achieved that the thermal expansion of the support element is adapted to the thermal expansion of the support shaft. If operating conditions cause the camshaft module to change its temperature, the expansion of the support element is matched to the expansion of the support shaft in the axial direction. The actuators are therefore shifted to match the shifting of the sliding cam pieces, for example in the event of an expansion in length of the support shaft. The effect thereby achieved is that the actuators which are assigned to the sliding cam pieces always take up axial positions which are coordinated with one another, even in the event of severe fluctuations in the temperature of the camshaft module, without preventing the axial position of the sliding cam pieces and of the actuators actually changing. As long as the positional shifting of the actuators in the axial direction of the camshaft remains matched to the positional shifting of the sliding cam pieces, the degree to which the change in position actually takes place can be left open.

A particular advantage is achieved with a punctiform axial fixing of the support element, i.e. if the support element is accommodated in an axially fixed manner on the module body at a connecting point. Leading on from this, an axial bearing for the axial supporting of the camshaft is provided, on which or adjacent to which the connecting point is formed. A common thermal origin therefore arises to a certain extent for the support element and for the support shaft. In the event of temperature changes, the length of the support element and of the support shaft increase or decrease uniformly starting from said connecting point. In other words, the support element is also thermally supported at the connecting point. A temperature-induced extension of the support element over the length always takes place here with the same value as a change in length of the support shaft. If the sliding cam pieces and the actuators are arranged at the same distance from the connecting point, the changes in position of the sliding cam piece and of the actuator also behave in a complementary manner with respect to one another.

The module body is constructed, for example, from a number of bearing bridges and a hood which connects the bearing bridges to one another. The axial bearing is formed, for example, at least with a part on or in one of the bearing bridges, wherein the connecting point is formed by means of a connecting means which connects the support element at least indirectly to the bearing bridge. For example, the connecting means forms a cylinder pin or a screw, and the support element is pinned and/or screwed to the bearing bridge with the connecting means. In particular, the connecting means is designed in such a manner that the support element takes up a precise axial position within predetermined tolerances relative to the axial bearing of the camshaft. As a result, the thermal expansion behavior of the hood of the module body no longer plays any role in the position of the actuators relative to the sliding cam pieces.

In a departure from the further example of a hood with a number of bearing bridges, the module body can also be formed by a cylinder head in which at least one camshaft is accommodated.

Furthermore, it is provided that the support element is accommodated so as to be guided in an axially movable manner on the module body at at least one guide point, in particular at a plurality of guide points. The axial positioning of the support element relative to the axial bearing takes place here particularly advantageously only in precisely one connecting point, wherein a plurality of guide points accommodate the support element in an axially movable manner on the module body, for example at the bearing bridges. If the support element expands to a greater or lesser extent than the hood or the basic body of the module body, the guide point permits a sliding movement of the support element on the module body. Twisting between the module body and the support element is thus avoided. The guide point or the guide points is or are designed in such a manner that the actuators are oriented in a manner fixedly positioned with respect to the camshaft, in particular in the lateral direction, i.e. transversely with respect to the direction of extent of the support shaft.

The guide points are formed, for example, by guide elements which can slide in elongated holes or in the edge region of the support element.

In order to accommodate the actuators in a positionally precise manner on the support element, the support element, according to a further exemplary embodiment, comprises centering receptacles. By means of the centering receptacles, the actuators can be accommodated in a manner positioned highly precisely on the support element. For example, the centering receptacles are formed by annular elements with a cylindrical internal size, through which a portion of the actuators is guided and forms a fit. The annular elements are pressed, for example, into the support element and machined on the inside in order to produce a precise fitting size.

According to a further advantageous embodiment of the camshaft module, the actuators each comprise at least one actuator pin which is guided relative to the assigned sliding cam piece at least indirectly by means of the support element. The actuator pin is as a rule guided in the housing of the actuator, and, according to a further exemplary embodiment, the actuator pin is guided in a guide of the support element, as a result of which even greater accuracy of the actuator pin relative to the sliding cam piece is achieved, in particular in the axial direction.

For example, the actuators comprise a housing part and a support part, wherein the support part comprises a centering portion by means of which the actuator is arranged on the support element. The centering region sits, for example, in the centering receptacle, and forms a fit therewith.

An advantageous further embodiment makes provision for the actuators to comprise a housing part which is formed, for example, from plastic and with which said actuators are injection molded on the support element by means of an injection molding process. By means of this variant, the support part, which is frequently formed from metal, is dispensed with, and the actuator pin is particularly advantageously guided directly in or on the support element.

According to yet another exemplary embodiment, the support element comprises support parts which are assigned to the actuators, are fixedly connected to the support element and to which the housing parts are attachable, for example are injection moldable or castable thereon. The support parts are therefore formed integrated in the support plate. Leading on from this, there is the possibility that, after arrangement of the essential components of the actuators, for example a magnetic unit with the actuator pin, the housing part is injection molded in the injection molding process onto the support part formed integrally in the support element.

The support element can be designed in various ways, in particular the support element comprises a steel material or a plastics composite material. If the support element is formed, for example, by a sheet metal element, the latter comprises a flat inner region and edge regions which are bent around laterally. A high degree of rigidity of the support element is thereby achieved, and the support element can be produced in a simple manner by a punching and bending process.

FIG. 1 shows a perspective view of a camshaft module 1 with a module body 10, in which two camshafts 11 for controlling valves for the charge cycle of an internal combustion engine are accommodated. The camshaft module 1 serves in particular for mounting on a cylinder head of the internal combustion engine.

The module body 10 has a hood 26, and, on the lower side of the hood 26, a plurality of bearing bridges 19 are arranged connected to the latter. The camshafts 11 are accommodated rotatably on the module body 10 by means of the bearing bridges 19. The camshafts 11 each have a support shaft 12, and a plurality of sliding cam pieces 13 are accommodated so as to be movable in an axial direction 14 on each of the support shafts 12. In order to change an axial position of the sliding cam pieces 13, actuators 15 are assigned to the respective sliding cam pieces 13, wherein, for the camshaft module 1 shown, four actuators 15 are provided, of which two actuators are shown.

The exemplary embodiment shows the feature, which is essential to the invention, of a support element 16 in the form of a sheet-metal element, and the sheet-metal element comprises a steel material which has a coefficient of thermal expansion which is identical or similar to the coefficient of thermal expansion of the support shaft 12. The support element 16 extends here in the same manner as the support shaft 12 of the camshaft 11 in the axial direction 14, and therefore the support element 16 is oriented parallel to the support shaft 12.

An axial bearing 18 for axially supporting the camshaft 11 is located in an arrangement on the front first bearing bridge 19, and, in conjunction with the axial bearing 18, in particular in the form of a structural unit with the bearing bridge 19, a connecting point 17 is provided, via which the support element 16 is arranged and consequently supported axially on the axial bearing 18 and therefore on the bearing bridge 19. The connecting point 17 is formed by two connecting means 20, illustrated by two screws.

At the positions of the actuators 15 (not illustrated), the support element 16 comprises centering receptacles 22 into which the actuators 15 are inserted in a positionally precise manner. For this purpose, the actuators 15 comprise a housing part 24, for example made of plastic, and a support part 28, for example made of metal, wherein the support part 28 is inserted with a corresponding centering portion into the respective centering receptacle 22 in a precisely fitting manner. Consequently, the position of the actuators 15 relative to the axial bearing 18 of the camshaft 11 is exactly determined by the support element 16.

If a change in temperature of the camshaft module 1 takes place, for example when starting up the internal combustion engine, the individual components of the camshaft module 1 expand in a manner induced by the temperature. By means of the thermal expansion, the axial positions of the sliding cam pieces 13 are shifted, and, by means of a coefficient of thermal expansion of the support element 16 accommodating the actuators 15, shifting of the actuators 15 takes place, said shifting being identical in the axial direction 14, starting from the axial bearing 18, to the shifting of the sliding cam pieces 13 because of the thermal expansion of the support shaft 12. The support element 16 is located below the hood 26, which is shown broken open, and the hood 26 is sealed in relation to the outer side with sealing elements via corresponding fastening domes 30 in order to attach the actuators 15 by means of fastening formations 29. By the support element 16 being accommodated on the inside below the hood 26, the support element 16 is washed around with the same oil as the camshaft 11, and therefore the support element 16 substantially takes on the same temperature as the camshaft 11.

Guide points 21 are provided in order to accommodate the support element 16 on the module body 10 in a manner guided in the axial direction 14. A plurality of guide points 21 guide the support element 16 on the module body 10, and, in the event of thermal expansion, a movement is made possible between the support element 16 and the module body 10, in particular relative to the bearing bridges 19. Only in the connecting point 17 does no movement take place between the bearing bridge 19 and the support element 16, and therefore the guide points 21 are formed, for example, by holding elements which run through elongated holes in the support element 16. Twisting of the support element 16 on the module body 10 is therefore avoided.

Figure 2:
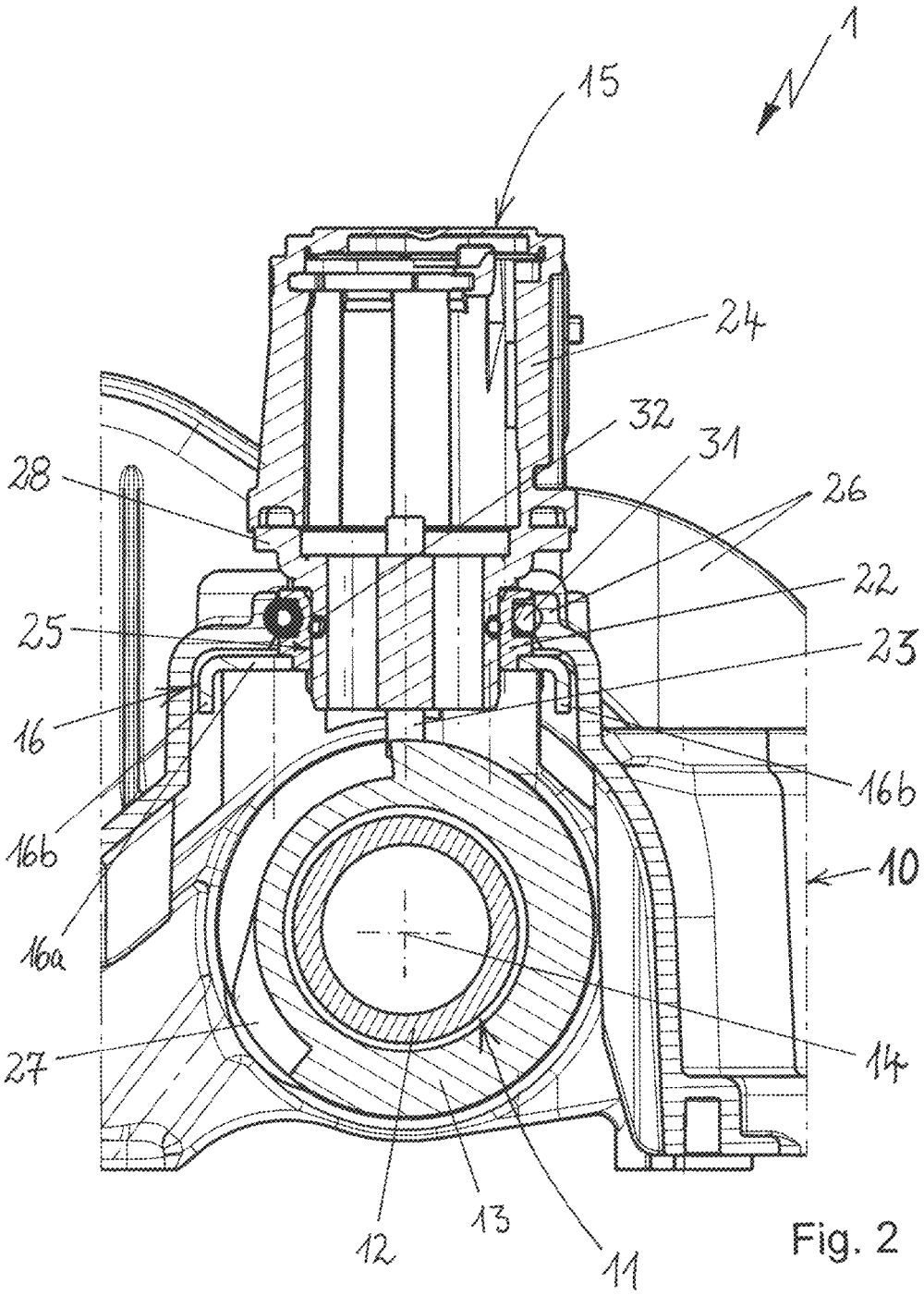
FIG. 2 is a cross-sectional view of an example camshaft module in a region of a camshaft, wherein a sectional plane lies transversely with respect to an axial direction, and wherein a support element is formed within a hood.

FIG. 2 shows a sectional view through the camshaft module 1 in an intersecting plane to which the axial direction 14 of the camshaft 11 is perpendicular. The section runs through the module body 10 in such a manner that the hood 26 is illustrated sectioned. The support element 16 is shown in a region of a centering receptacle 22, and the centering receptacle 22 forms an annular element into which a centering region 25 is inserted in a precisely fitting manner, wherein the centering region 25 forms a portion of a support part 28 of the actuator 15. The housing 24 of the actuator 15 is located above the support part 28.

On the lower side of the support part 28, the actuator 15 comprises an actuator pin 23 which is shown retracted into a slotted guide 27 by magnetic lifting. The slotted guide 27 is provided on the outer side in the sliding cam piece 13. The sliding cam piece 13 sits on a support shaft 12 and, together with the latter, forms the camshaft 11.

The exemplary embodiment shows the support element 16 in the form of a sheet-metal element with an inner region 16*a*, in which the centering receptacle 22 is accommodated, and edge regions 16*b* are located laterally with respect to the inner region 16*a*. As a result, the support element 16 in the form of a sheet-metal element obtains a U shape and is substantially stiffened by the latter.

Located between the hood 26 and the outer side of the centering receptacle 22 is a first sealing element 31 which permits a certain movability between the centering receptacle 22 and the hood 26 and is therefore oversized. Located on the inside of the centering receptacle 22 is a second sealing element 32 which brings about sealing between the centering region 25 of the metal support part 28 and the centering receptacle 22.

Figure 3:
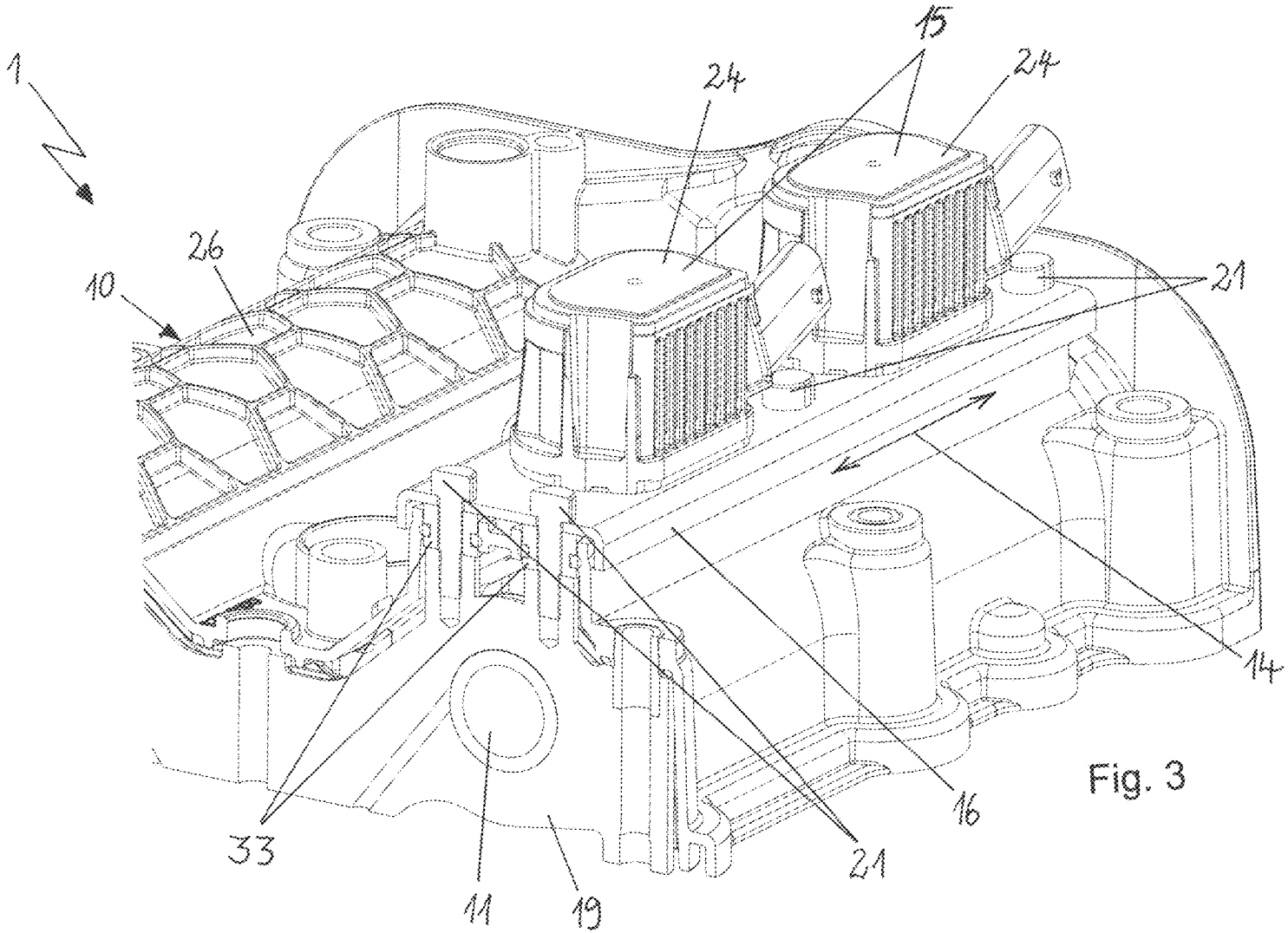
FIG. 3 is a sectional view of another example camshaft module.

FIG. 3 shows a further exemplary embodiment of the camshaft module 1 with a module body 10, comprising a hood 26 and a plurality of bearing bridges 19. The support element 16 is fastened to the bearing bridges 19 by the guide points 21 in a manner guided in the axial direction. The guide points 21 are formed by screw-like elements and pass through an elongated hole in the support element 16 in a manner not shown specifically. Consequently, a slight, thermally induced movement of the support element 16 in the axial direction 14 is possible, wherein the connecting points 17 guide the support element 16 over the bearing bridges 19.

In this exemplary embodiment, the actuators 15 are formed only with the housing part 24 as a housing element made from plastic, and the plastics material of the housing part 24 is injection molded onto the support element 16. In a manner not illustrated specifically, the actuators 15 can therefore be formed without a metallic support part 28, and the actuator pin is particularly advantageously guided directly in the support element 16, as a result of which the axial precision of the actuator pin 23 relative to the sliding cam pieces 13 of the camshaft 11 is further increased.

The support element 16 is arranged in the outer region on the hood 26 of the module body 10. For sealing the inner region below the hood 26, use is made, for example, of sealing sleeves 33 through which the guide elements which form the guide points 21 are guided. For this purpose, the sealing sleeves 23 comprise, for example, O rings.

Figure 4:
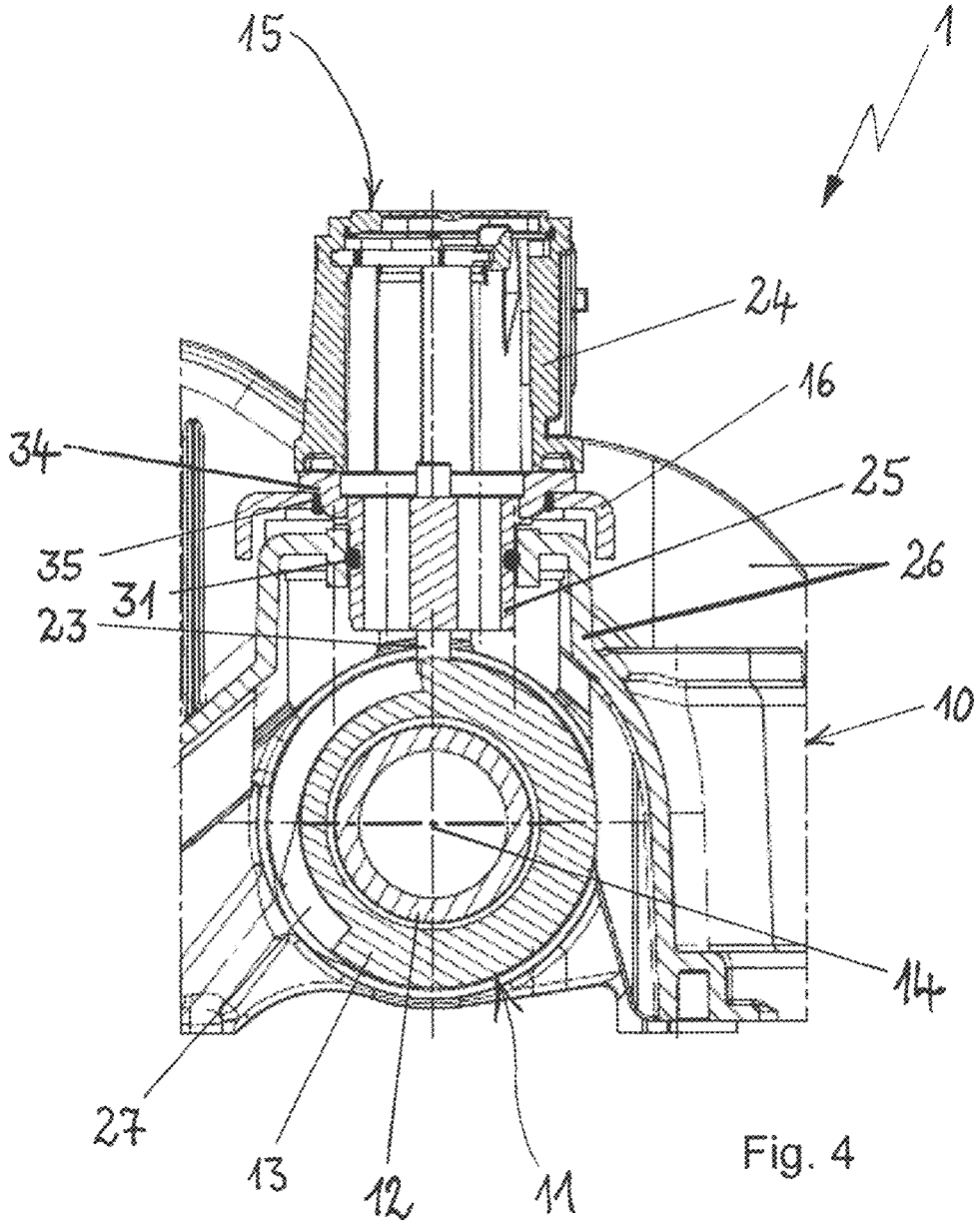
FIG. 4 is a cross-sectional view of another example camshaft module in a region of a camshaft, wherein a sectional plane lies transversely with respect to an axial direction, and wherein a support element is formed outside a hood.

FIG. 4 illustrates a sectional view of the camshaft module 1 in an intersecting plane to which the axial direction 14 of the camshaft 11 is perpendicular, and the hood 26 as part of the module body 10 is illustrated sectioned.

The exemplary embodiment shows the support element 16 in cross section which, in a delimitation from the exemplary embodiment from FIG. 2, is arranged outside and, in the plane shown, above the hood 26 and therefore takes up the design as per FIG. 3. An actuator 15 is accommodated on the support element 16, said actuator being able to act with an actuator pin 23 on the sliding cam piece 13, which is shown in cross section, of the camshaft 11, in order to displace said sliding cam piece in the axial direction 14 on the support shaft 12, which is likewise shown transversely sectioned. For this purpose, the actuator pin 23 engages in a slotted guide 27 in the sliding cam piece 13.

The actuator 15 has a housing part 24 which is formed, for example, from plastic and in which a magnetic coil with a magnetic armature can be introduced, the magnetic armature acting directly or indirectly on the actuator pin 23 and initiating a lifting movement therein.

The exemplary embodiment furthermore shows the actuator 15 with a support part 34 which is part of the support element 16. For example, the support part 34 is formed integrally with the support element 16, or the support part 34 is inserted into a corresponding opening in the support element 16 and is connected to the support element 16 via a joining connection 35, for example is pressed therein or connected thereto in an integrally bonded manner. A particular advantage arises in particular if the centering portion 25 is also formed integrally with the support part 34, and therefore, when the actuator 15 is placed on, the actuator pin 23 is guided directly in a structural component of the support element 16 without joining tolerances accumulating. The actuator as a separable component can therefore be formed without its own support part, and the actuator pin 23 can be guided in the support part 34, which is part of the support element 16, as a result of which highly precisely carrying along of the actuator pin 23 is achieved with a thermal expansion movement of the support element 16.

In particular, a housing part 24 which is formed from plastic can be screwed or even cast on the support part 34, for example by injection molding the housing part 24 on to the support part 34 in an injection molding process. Located between the hood 26 and the outer side of the centering portion 25 is a sealing element 31 which permits a certain movability between the centering portion 25 and the hood 26.

The invention is not restricted in its embodiment to the exemplary embodiments indicated above. On the contrary, a number of variants is conceivable which make use of the illustrated solution, even where the embodiments are of a fundamentally different type. All of the features and/or advantages emerging from the claims, the description or the drawings, including design details or spatial arrangements, can be essential to the invention, either individually or in a very wide range of combinations.

LIST REFERENCE SIGNS

1 camshaft module
10 module body
11 camshaft
12 support shaft
13 sliding cam piece
14 axial direction
15 actuator
16 support element
16*a* inner region
16*b* edge region
17 connecting point
18 axial bearing
19 bearing bridge
20 connecting means
21 guide point
22 centering receptacle
23 actuator pin
24 housing part
25 centering portion
26 hood
27 slotted guide
28 support part
29 fastening formation

30 fastening dome
31 sealing element
32 sealing element
33 sealing sleeve
34 support part
35 joining connection

What is claimed is:

1. A camshaft module comprising:

a module body in which a camshaft for controlling valves for a charge cycle of an internal combustion engine is accommodated, the module body having a hood, wherein the camshaft comprises a support shaft and sliding cam pieces that are accommodated on the support shaft so as to be displaceable in an axial direction along the support shaft; and a support element on which actuators for an axial displacement of the sliding cam pieces are accommodated, wherein the support element extends in the axial direction parallel to the support shaft and is disposed below the hood of the module body, wherein a coefficient of thermal expansion of the support element substantially corresponds to a coefficient of thermal expansion of the support shaft.

2. The camshaft module of claim 1 wherein the support element is accommodated in an axially fixed manner on the module body at a connecting point, the camshaft module further comprising an axial bearing for axially supporting the camshaft, wherein the connecting point is disposed on or adjacent to the axial bearing.

3. The camshaft module of claim 2 wherein the module body comprises bearing bridges, wherein at least a part of the axial bearing is disposed on or in one of the bearing bridges, wherein the connecting point comprises a connecting means that connects the support element at least indirectly to the one of the bearing bridges.

4. The camshaft module of claim 1 wherein the support element is accommodated on the module body so as to be guided in an axially-movable manner at a guide point.

5. The camshaft module of claim 1 wherein the support element comprises centering receptacles by way of which the actuators are accommodated in a manner positioned on the support element.

6. The camshaft module of claim 1 wherein at least some of the actuators are assigned to the sliding cam pieces.

7. The camshaft module of claim 1 wherein each of the actuators comprises an actuator pin that is guidable, at least indirectly by way of the support element, relative to a respective sliding cam piece of the sliding cam pieces that has been assigned to the actuator.

8. The camshaft module of claim 1 wherein the actuators comprise a housing part and a support part, wherein the support part comprises a centering portion by way of which each actuator is positioned on the support element.

9. The camshaft module of claim 1 wherein the actuators comprise a housing part that is comprised of plastic and with which the actuators are injection molded on the support element by way of injection molding.

10. The camshaft module of claim 1 wherein the support element comprises support parts that are assigned to the actuators, that are fixedly connected to the support element, and that are configured to be attached to housing parts.

11. A camshaft module comprising:

a module body in which a camshaft for controlling valves for a charge cycle of an internal combustion engine is accommodated, the module body having a hood, wherein the camshaft comprises a support shaft and sliding cam pieces that are accommodated on the support shaft so as to be displaceable in an axial direction along the support shaft; and a support element on which actuators for an axial displacement of the sliding cam pieces are accommodated, wherein the support element extends in the axial direction parallel to the support shaft and is disposed below the hood of the module body, wherein the support element is accommodated on the module body so as to be guided in an axially-movable manner at a guide point.

12. The camshaft module of claim 11 wherein the support element is accommodated in an axially fixed manner on the module body at a connecting point, the camshaft module further comprising an axial bearing for axially supporting the camshaft, wherein the connecting point is disposed on or adjacent to the axial bearing.

13. The camshaft module of claim 12 wherein the module body comprises bearing bridges, wherein at least a part of the axial bearing is disposed on or in one of the bearing bridges, wherein the connecting point comprises a connecting means that connects the support element at least indirectly to the one of the bearing bridges.

14. The camshaft module of claim 11 wherein the support element comprises centering receptacles by way of which the actuators are accommodated in a manner positioned on the support element.

15. The camshaft module of claim 11 wherein at least some of the actuators are assigned to the sliding cam pieces.

16. The camshaft module of claim 11 wherein each of the actuators comprises an actuator pin that is guidable, at least indirectly by way of the support element, relative to a respective sliding cam piece of the sliding cam pieces that has been assigned to the actuator.

17. The camshaft module of claim 11 wherein the actuators comprise a housing part and a support part, wherein the support part comprises a centering portion by way of which each actuator is positioned on the support element.

18. The camshaft module of claim 11 wherein the actuators comprise a housing part that is comprised of plastic and with which the actuators are injection molded on the support element by way of injection molding.

19. The camshaft module of claim 11 wherein the support element comprises support parts that are assigned to the actuators, that are fixedly connected to the support element, and that are configured to be attached to housing parts.

* * * * *